United States Patent [19]

Abramoska, Jr.

[11] 4,100,948

[45] Jul. 18, 1978

[54] LIQUID FILLING TUBE WITH PROTECTIVE TIP

[75] Inventor: Alfred A. Abramoska, Jr., Medina, Ohio

[73] Assignee: Arthur Products Co., Medina, Ohio

[21] Appl. No.: 760,685

[22] Filed: Jan. 19, 1977

[51] Int. Cl.[2] ..... B65B 3/04; B67C 3/02

[52] U.S. Cl. ..... 141/392

[58] Field of Search ..... 141/392, 267, 53, 59–61, 141/57, 58, 285–311; 239/587, 602, DIG. 19; 285/333, 334

[56] References Cited

U.S. PATENT DOCUMENTS

| | | | |
|---|---|---|---|
| 1,831,586 | 11/1931 | Barr | 239/602 |
| 2,461,326 | 2/1949 | Kantor et al. | 141/367 |
| 3,935,886 | 2/1976 | Duncan | 141/392 |
| 4,014,372 | 3/1977 | Dichiara | 141/392 |

FOREIGN PATENT DOCUMENTS

| | | | |
|---|---|---|---|
| 1,115,863 | 5/1968 | United Kingdom | 239/602 |

*Primary Examiner*—Houston S. Bell
*Attorney, Agent, or Firm*—Bosworth, Sessions & McCoy

[57] ABSTRACT

A filling tube for use in a container filling machine in which the tube is vertically disposed within a container as the container is being filled with a liquid. The lower end of the tube is adapted for insertion downwardly into the container and the upper end of the tube is provided with means for attachment to the filling machine. The lower end of the tube has an externally threaded portion with a pair of annular sealing portions, one sealing portion on either side of the threaded portion. A protective end tip member formed of a soft, low moisture absorbent material is secured to the lower end of the tube. The soft tip member minimizes damage to glass containers as the filling tube is inserted into the container. The tip member has an internally threaded portion which engages the externally threaded portion of the tube to secure the tip to the tube. The tip member also has a pair of annular sealing portions corresponding to the sealing portions of the tube which abut the tube sealing portions to form a tight seal. The sealing portions of the tube and the tip member preferably each comprise two nonparallel sealing surfaces. The sealing surfaces prevent the formation of pockets or reservoirs for the material being filled which would otherwise breed bacteria.

7 Claims, 4 Drawing Figures

LIQUID FILLING TUBE WITH PROTECTIVE TIP

BACKGROUND OF THE INVENTION

This invention relates to filling tubes for automatic container filling machines of the type that are widely used in the beverage industry for filling containers such as bottles and the like.

Automatic container filling machines involve a series of dispensing heads and conveyor mechanisms which automatically operate to bring the beverage containers to be filled, such as glass bottles, into contact and seated with the heads, whereupon a liquid, such as beer, is automatically discharged into the containers.

The filling cycle includes the initial step or stage of placing the bottle or other container in sealed relation with a filling head which includes a filling tube, usually made of stainless steel, which is vertically disposed to project downwardly into the container being filled. A container centering bell is mounted to be vertically slidable upon the filling tube. As the container is placed into position to be filled with liquid, the mouth of the container is seated against a sealing ring in the centering bell when the centering bell is in its lowered position. The container is then raised and the centering bell slides up the filling tube until the filling tube is in position, projecting downwardly into the container. The container may then be placed in communication with a gas reservoir so that pressure is established in the container, prior to filling the container with beer or other liquid. When the container is filled to a predetermined level with liquid, the flow is stopped, and the container is lowered from the filling apparatus.

The outer diameter of the filling tube is usually large so that it fits within the mouth of the container with a relatively small clearance. As a result, the hard stainless steel tube may contact the glass container when the tube is inserted into the neck of the bottle, usually causing chipping of the glass which can enter the container and contaminate the product. The hard stainless steel filling tube can also cause damage to the slidable sealing bell which fits over the top of the container, and which is conventionally made from brass or a similar material. The damage to the sealing bell is caused by a stop means formed at the lower end tip of the tube which prevents the bell from sliding beyond the end of the tube. When the container is lowered from the filling head and the bell slides down the tube, the stop on the tip of the hard stainless steel tube hits the softer brass bell. The continual dropping of the bell onto the stop on the tube during the operation of the filling machine can eventually damage the bell.

It would be advantageous to replace the tubes of stainless steel with those of another material, but stainless steel tubes are preferred because of their strength, durability and cleanliness. The end tip of the stainless steel tube could be made of a material other than stainless steel, but there are many problems associated with such a design. One problem relates to the formation of an effective seal between the tip and the stainless steel tube body. Without an effective seal, pockets could form between the tip and the tube body, providing a reservoir for the product to stagnate and for bacteria to collect. Another problem relates to the absorbency of the material of the tip. The tip must be soft, but many soft materials also tend to swell when wet, causing the tip to expand and loosen from the tube body.

SUMMARY OF THE INVENTION

It is an object of the present invention to provide a filling tube with a protective end tip member made of a soft material. Another object is to provide a vent tube which will eliminate the problem of the chipping of glass containers as the filling tube enters the container when the container is raised into position for filling. Still another object is to provide a filling tube which reduces the damage caused to the slidable sealing bell when the bell is dropped to the end tip of the tube as the filled container is lowered from the filling mechanism. Yet another object is to provide a filling tube in which an effective seal is formed between the protective end tip member and the body of the tube to prevent the entrance of the liquid between these members, causing the formation of pockets or reservoirs for the formation of bacteria. Yet another object is to provide a filling tube with a protective end tip member formed of a low moisture absorbent material so that the end tip will not swell and expand and loosen from the tube.

These and other objects are accomplished by the present invention which provides a filling tube having a protective end tip member secured to the lower end of the tube, the tip being formed of a soft, low moisture absorbent material. The tube has an interior axially extending passage through which the fluid may pass as the container is being filled. The lower end of the tube has an externally threaded portion with a pair of annular sealing portions, one sealing portion on either side of the externally threaded portion. The tip member has a socket with an internally threaded portion which engages the externally threaded portion of the tube to secure the tip member to the tube. The tip member also has a pair of sealing portions corresponding to the sealing portions of the tube which abut the tube sealing portions to form a tight seal. The tip member further has a dispensing hole which communicates with the passage in the tube.

DESCRIPTION OF THE PREFERRED EMBODIMENTS

Figure 1:
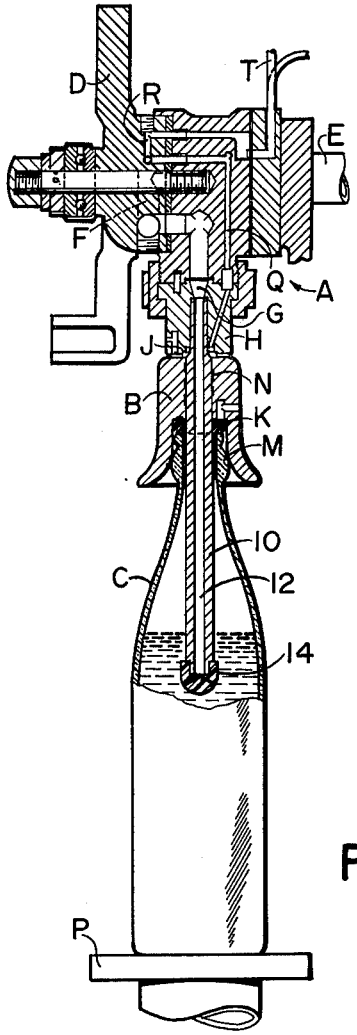
FIG. 1 is a fragmentary vertical cross-section of a filling mechanism of a container filling machine of conventional construction, except that it embodies a filling tube made according to the present invention.

Referring to the drawings in detail, FIG. 1 shows a portion of a filling mechanism A of a conventional container filling machine, specifically a beer bottle filling machine. Since the filling tube of the present invention may be employed with a container filling machine of known conventional constuction, this mechanism A will not be described here in detail. During the liquid flow stage of operation of the filling mechanism, a disk-like valve element D is positioned to allow for the fluid to be filled, such as beer, to flow from a reservoir through a tube E and a connected passage within the mechanism into a U-shaped liquid passage F in the disk valve D and thence downwardly by a passage G and through a filling tube 10. The filling tube 10 is supported centrally of a collar H of the filling mechanism to project downwardly into a container C, such as a bottle, supported on a filling platform P. A container centering bell B is vertically slidable on the tube 10. The bell B has a sealing ring K against which the mouth M of the container C is adapted to seal. The bore of the centering bell B is provided with a spiral passage N surrounding the filling tube 10. While the liquid is flowing into the container C, the counter pressure gas and air in the container C is returned through the spiral passage N to a chamber J and then through a passage Q to a return passage R and eventually to a tube T.

In the operation of the filling machine, an empty container C supported on the platform P is raised into position. The centering bell B which is slidable on the tube 10 is in its lowermost position such that it extends beyond the lower tip of the filling tube 10. As the container C is raised, the mouth M of the container engages the centering bell B and the container is raised upwardly as the bell slides upwardly along the tube 10, until the bell is in its uppermost position as shown in FIG. 1. The filling machine then performs a counter pressurization operation during which the container is filled with a counter pressure gas. Thereafter, the machine performs the filling operation using the mechanism already described in which the container C is filled with liquid nd the counter pressure gas and air in the bottle are evacuated. The filled container is then lowered from the machine by lowering of the platform P, and the filling mechanism is ready to accept a new empty container.

During the procedure in which the container is raised into position for filling, there have frequently been problems when the container mouth M engages the hard lower tip of the tube causing the glass to chip. Problems have also resulted when the container is lowered from the filling machine and the center bell B drops onto the hard lower tip causing damage to the bell. To obviate these problems the lower tip of the filling tube 10 of the present invention is provided with a protective member 14 formed of a soft synthetic resin or elastomeric material. Preferably, the tip member 14 is formed of an acetal homopolymer, available under the trademark Delrin. This material is preferred because it is substantially non-absorbent, and will not significantly absorb the liquid which is being used to fill the container C. If an absorbent material were used, the material would tend to swell or expand, causing the tip member 14 to loosen. It has been found that Delrin material expands only approximately 0.2 percent under the conditions encountered by the tip member in the filling operation. In contrast, nylon, which is another synthetic resin material otherwise suitable, expands approximately 12 percent under the same conditions. Delrin material is also preferred because of its easy machineability, allowing it to be fabricated into the protective tip. Also, the member has been approved for use in the packaging of food products by U.S. Food and Drug Administration.

Figure 2:
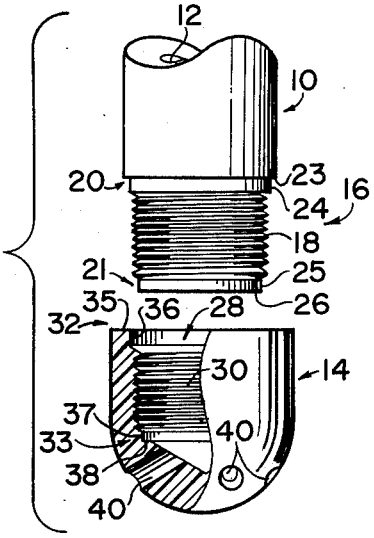
FIG. 2 is an elevation partially sectioned showing the lower end of the filling tube of FIG. 1 with the protective tip member removed.

The means for securing the tip member 14 to the lower end of the tube 10, must provide a tight sealing engagement between the members to prevent the formation of pockets or reservoirs for the formation of bacteria. The securing means of the present invention is shown in detail in FIGS. 2 and 3. The lower end 16 of the filling tube 10 comprises an externally threaded portion 18. Flanking the threaded portion 18 are sealing portions 20 and 21. Each of the sealing portions 20 and 21 preferably comprises two nonparallel sealing surfaces. In the upper sealing portion 20, there are horizontal sealing surface 23 and a vertical sealing surface 24. Likewise, in the lower sealing portion 21, there are a vertical sealing surface 25 and a horizontal sealing surface 26.

Figure 3:
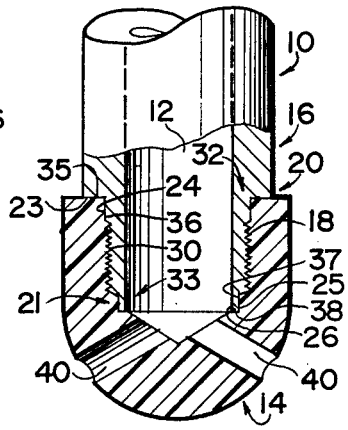
FIG. 3 is a transverse cross-sectional view of the lower end of the tube of FIG. 2 with the tip member secured to the tube.

The protective tip member 14 has a receiving socket 28 with portions corresponding to the portions of the lower end 16 of the filling tube 10. An internally threaded portion 30 engages the externally threaded portion 18. On either side of the internally threaded portion 30 are sealing portions 32 and 33. The upper sealing portion 32 comprises a horizontal sealing surface 35 and a vertical sealing surface 36, and the lower sealing portion 33 comprises a vertical sealing surface 37 and a horizontal sealing surface 38. The sealing surfaces 35, 36, 37 and 38 of the socket 28 are dimensioned to abut, bear against, and tightly seal against the corresponding sealing surfaces 23, 24, 25 and 26, respectively, of the lower end 16 of the filling tube 10, as shown in FIG. 3. By providing a plurality of sealing surfaces oriented in various nonparallel directions, the resulting seal is more effective than would be otherwise provided.

The lower protective tip 14 also contains a plurality of dispensing holes 40 which communicate with the bottom of the passage 12. The holes 40 provide the exit for the liquid which flows down through the passage 12 as the container C is being filled. Commonly, the holes 40 are circumferentially spaced around the outside of the tip 14 and extend angularly from the bottom of the passage 12 as shown in FIG. 3.

Figure 4:
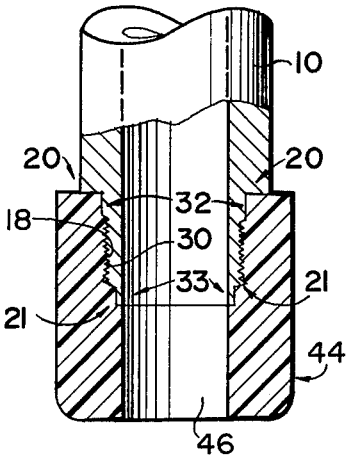
FIG. 4 is a transverse cross-sectional view of a lower end of a filling tube showing another embodiment of the present invention.

In another embodiment of the present invention shown in FIG. 4, the tip 44 may be provided with a larger single hole 46 in the bottom of the tip which provides an extension of the passage 12 in the filling tube 10. This flow-through design is advantageous in the dispensing of certain beverages where the turbulence caused by the plurality of angled holes 40 is avoided. As with the other embodiment of the present invention, the tip 44 is preferably provided with an internally threaded portion 30 which engages the externally threaded portion 18 on the bottom of the tube 10, and sealing portions 32 and 33 each comprising at least two sealing surfaces, which seal against the corresponding sealing portions 20 and 21 of the tube.

Various other modifications, changes, and adaptions of the preferred forms of the invention may become evident to persons skilled in the art. The embodiments shown herein are for the purposes of illustration rather than limitation. Therefore, it is to be understood that this patent is not limited to the preferred forms described herein or in any manner other than by the scope of the following claims.

I claim:

1. A filling device for a container filling machine for verticl disposition within a container as the container is being filled with a fluid, which comprises:

a filling tube having an interior axially extending passage through which the fluid may pass as the container is being filled, the tube having a lower end adapted for insertion downwardly into the container, the tube having an upper end with means for attachment to the filling machine, the lower end having a threaded portion with a pair of annular sealing portions, one sealing portion on either side of the threaded portion, each sealing portion comprising two nonparallel sealing surfaces; and a protective end tip member secured to the lower end of the tube, the tip member formed of a soft low moisture absorbent material, the tip member having a threaded portion which engages the threaded portion of the tube to fixedly secure the tip member to the tube, the tip member having a pair of annular sealing portions, one sealing portion on either side of the internally threaded portion, each sealing portion comprising two nonparallel sealing surfaces, the sealing surfaces corresponding to the sealing surfaces of the tube which abut the sealing surfaces of the tube to form a tight seal, the tip member having a dispensing hole which communicates with the passage in the tube.

2. A filling device as in claim 1 wherein said two nonparallel sealing surfaces are normal to each other.

3. A filling device as in claim 1 wherein the threaded portion of the tip comprises a threaded socket and the threaded portion of the tube comprises a threaded shank which engages the threaded socket.

4. A filling device as in claim 1 wherein said soft low moisture absorbent material is acetal homopolymer.

5. A filling device as in claim 1 wherein said soft low moisture absorbent material is elastomeric material.

6. A filling device as in claim 1 wherein the tip member has an outer diameter larger than the outer diameter of the tube.

7. A filling device for a container filling machine for vertical disposition within a container as the container is being filled with a fluid, which comprises:

a filling tube having an interior axially extending passage through which the fluid may pass as the container is being filled, the tube having a lower end adapted for insertion downwardly into the container, the tube having an upper end with means for attachment to the filling machine, the lower end having an externally threaded portion with a pair of annular sealing portions, one sealing portion on either side of the externally threaded portion, each sealing portion comprising a horizontally extending annular sealing surface and a vertically extending annular sealing surface; and a protective end tip member secured to the lower end of the tube, the tip member having an outer diameter larger than the outer diameter of the tube, the tip member being formed of a soft low moisture absorbent acetal homopolymer material, the tip member having a socket with an internally threaded portion which engages the externally threaded portion of the tube to fixedly secure the tip member to the tube, the socket having a pair of annular sealing portions, one sealing portion on either side of the internally threaded portion, each sealing portion comprising a horizontally extending annular sealing surface and a vertically extending annular sealing surface, the sealing surfaces corresponding to the sealing surfaces of the tube which abut the sealing surfaces of the tube to form a tight seal, the tip member also having a dispensing hole which communicates with the passage in the tube.

* * * * *